US005117923A

United States Patent [19]

Wuhrer

[11] Patent Number: 5,117,923

[45] Date of Patent: Jun. 2, 1992

[54] HYDRAULIC JACKHAMMER

[75] Inventor: Wolfgang Wuhrer, Ravensburg, Fed. Rep. of Germany

[73] Assignee: Sulzer Brothers Limited, Winterthur, Switzerland

[21] Appl. No.: 453,394

[22] Filed: Dec. 19, 1989

[30] Foreign Application Priority Data

Jan. 11, 1989 [CH] Switzerland ..... 074/89

[51] Int. Cl.[5] ..... B25D 9/12; B25D 17/22

[52] U.S. Cl. ..... 173/109; 173/73; 173/80; 173/122; 173/128; 173/DIG. 4; 173/210

[58] Field of Search ..... 173/114, 122, 123, 78, 173/79, 80, 59, 73, DIG. 3, 104, 14, 48, 109, 76, 117, 72, 128, 139, DIG. 4; 175/100, 107, 296, 297

[56] References Cited

U.S. PATENT DOCUMENTS

| | | | |
|---|---|---|---|
| Re. 20,365 | 5/1937 | Baker | 173/117 X |
| 2,145,760 | 1/1939 | Fetherston | 173/117 X |
| 2,251,224 | 7/1941 | Curtis | 173/78 X |
| 3,133,600 | 5/1964 | Hochreuter | 173/117 X |
| 3,685,593 | 8/1972 | Amtsberg et al. | 173/14 |
| 3,695,367 | 10/1972 | Catterfeld et al. | 173/163 |
| 3,865,194 | 2/1975 | Chatfield, Jr. | 173/73 X |

FOREIGN PATENT DOCUMENTS

| | | |
|---|---|---|
| 0268718 | 8/1912 | Fed. Rep. of Germany . |
| 0726586 | 10/1942 | Fed. Rep. of Germany . |
| 1192132 | 5/1965 | Fed. Rep. of Germany . |
| 1503195 | 2/1969 | Fed. Rep. of Germany . |
| 1809488 | 8/1969 | Fed. Rep. of Germany . |
| 2232410 | 1/1975 | France . |

*Primary Examiner*—Douglas D. Watts
*Assistant Examiner*—Clark F. Dexter
*Attorney, Agent, or Firm*—Kenyon & Kenyon

[57] ABSTRACT

The hydraulic jackhammer is provided with a rotor turbine which is driven by a liquid stream in order to activate the tup for driving against a jumper rod. After passing by the turbine rotor, the liquid stream is mixed with air and passed through a nozzle into a guide channel under pressure in order to cool the casing. Some of the liquid-air mixture is passed through the hollow jumper rod for spraying onto a jumper bit and sprayed onto the rock being drilled.

23 Claims, 2 Drawing Sheets

HYDRAULIC JACKHAMMER

Figure 1A:
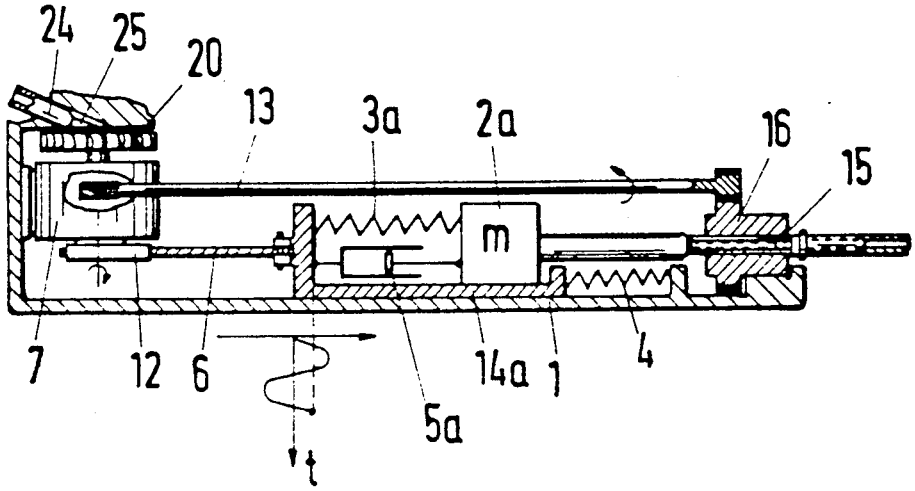

This invention relates to a hydraulic jackhammer.

As is known, various types of hydraulic jackhammers have been used to drill fixing holes and shot holes in rock. Preferably, the jackhammers have been used in the field of underground mining.

A review of the state of hydraulic jackhammers is given in the article entitled "Hydraulic Rockdrills" by Jeffrey Pearse (Mining Magazine—March 1985, pages 221 to 231, Mining Journal Ltd., 60 Worship Street, London EC2A 2HD) in which the products of seventeen makers are examined. A feature common to these hydraulic jackhammers or rockdrills is that they are operated, using oil or water and lubricating additives in a closed circuit at pressures between 75 to 220 bar. To produce a striking movement, a tup effective as a hydraulic piston is energized hydraulically by way of a changeover means. A pressure increase is produced by means of a pump and motor and the washing and cooling of a jumper bit proceeds by way of a separate water system. For their operation, the mechanical source of power—i.e. the motor—must be installed on the floor not too far away from the working face. Electricity or fuel and exhaust ducts are also necessary for the operation of such drills.

Pneumatic rockdrills or jackhammers have also been used successfully in mining up to medium depths. However, because of flow losses and leakage looses, compressed air costs increase more than proportionally with increasing depth to such an extent as to justify the use of hydraulic jackhammers. In mines which deliver rock from floor depths of 2000 meters and more, the cutter faces of the jackhammers also impose limits when drilling into the face. The ambient temperature of the rock is so high that the heat content of the air becomes insufficient to cool down the rock adequately. The mine operators therefore not only have to bring down cooling water from above ground to the working places before the face to cool the machines, but also have to install diesel engines or electric motors on the floors as prime movers for the jackhammer. These two requirements lead to an enormous increase in costs with increasing depth. Further, where water is brought from above ground for cooling purposes, the water is usually sprayed onto the rock. As a consequence, some of the water evaporates.

By way of example, U.S. Pat. No. 3,685,593 describes a fluid operated rock drill having a pneumatically reciprocable piston hammer for pounding a striking bar. In this case, one fluid motor is operable to reciprocate a drive piston while a second fluid motor is provided to operate independently in order to transmit rotation through a gear and coupling to the striking bar as the bar is pounded by a hammer.

Accordingly, it is an object of the invention to so able to use cooling water supplied from above ground level at working depths deep underground that the dynamic pressure and the consumption of cooling and washing water necessary at the face are sufficient to drive a jackhammer.

It is another object of the invention to be able to utilize a stream of water in a jackhammer as a driving force for a jumper rod as well as for cooling the jumper rod.

It is another object of the invention to be able to cool a jackhammer in a simple efficient manner.

It is another object of the invention to use a single energy vehicle for operating a jackhammer and for cooling the jackhammer.

Briefly, the invention provides a hydraulic jackhammer which is comprised of a casing, a jumper rod slidably mounted in the casing and a tup mounted in the casing for impacting against one end of the jumper rod. In addition, a transmission is provided in the casing which is operatively connected to the tup for driving the tup in a striking direction towards the jumper rod.

In accordance with the invention, a turbine rotor is disposed in the casing and is operatively connected to the transmission for actuating the transmission in response to rotation of the rotor. A means is also provided in the casing for directing at least one liquid stream against the rotor for rotating the rotor.

Still further, an air opening is provided in the casing adjacent the rotor for admitting air into the casing and a collecting nozzle is positioned downstream of the rotor for collecting and mixing the liquid from the liquid stream after passage by the rotor and air from the air opening.

During operation of the jackhammer, the turbine rotor which is in the form of an impulse turbine is energized in part axially by at least the liquid stream. This, in turn, causes the transmission to operate so that the tup can be impacted against the jumper rod.

The collecting nozzle is disposed at the rotor exit in order to collect the liquid stream after being deflected by the rotor. In this respect, the collecting nozzle includes an entry for receiving the liquid passing from the rotor as well as a downstream narrow slot-like cross-section for forming the collected liquid into a jet or solid stream. The nozzle also has a diffuser-like cross-section which widens downstream of the narrow slot-like cross-section which leads into a guide passage which extends within the casing to the jumper rod in order to conduct the liquid and air mixture therethrough for cooling the casing.

Where the jumper rod is hollow, the end of the jumper rod communicates with the guide passage in the casing in order to receive the liquid and air mixture for cooling of the jumper rod and a drill bit connected at the other end of the jumper rod.

The jackhammer is operated so that, in a first step, a liquid stream is passed against the turbine rotor within the casing of the jackhammer to at least partially energize the rotor in order to effect a rotation and striking movement of the jumper rod. In this respect, the energy obtained from deflection of the liquid stream against the turbine rotor is used to energize the rotation and striking movement of the jumper rod. In a second step, ambient air is drawn into the casing, for example being supplied through a suction air opening with a filter. In this respect, the ambient air is drawn in at a negative pressure.

In a third step, the kinetic residual energy of the liquid stream deflected by the rotor is used on the injector principle to extract air and residual liquid from the turbine casing, to reduce their velocity by delay in a diffuser and to convey them onwards at an increased pressure. In a fourth step, the liquid-air mixture, which is at a pressure several times atmospheric pressure, is guided into a space between the tup and the jumper rod. In a fifth step, surplus liquid-air mixture is discharged to the environment. In a sixth step, a resilient air cushion forms in the tup part of the space bounded by the tup and the jumper rod and briefly receives some of the liquid displaced upon impacting of the tup.

In a seventh step, the liquid-air mixture is supplied as a cooling and washing agent through the hollow jumper rod to the jumper bit. The resistance of the liquid present between the end faces of striking tup and the jumper rod considerably increases the duration of the transmitted strike pulse when the surfaces strike one another and enable more power to be transmitted without the surfaces suffering mechanical damage.

What can be regarded as the advantages of the jackhammer are that only a single energy vehicle—i.e., the cooling water necessary at great working depths, has to be brought to the face and is used there as a driving and washing medium for drilling and as a coolant for the rock. The use of a turbine rotor obviates the need for high pressure seals, whose operation depends upon water quality, and leads to an open water circuit. The jumper bit is washed automatically as the rotor is driven. The water does not flow through sensitive control elements. The advance and drive of the jackhammer can be controlled by way of a single control element.

Figure 1B:
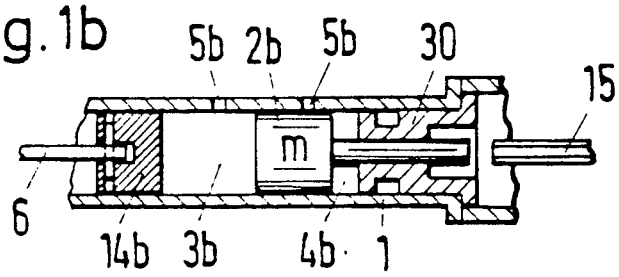
Figure 2:
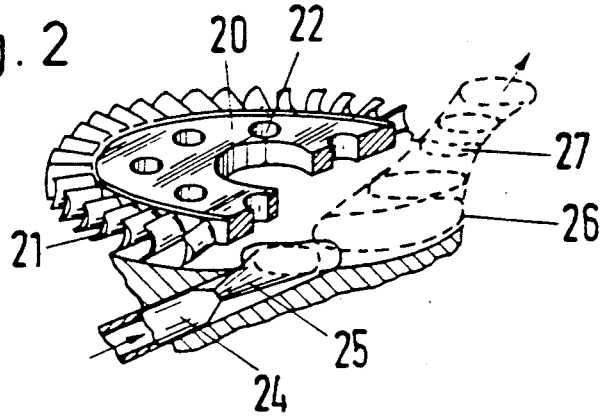
Figure 3:
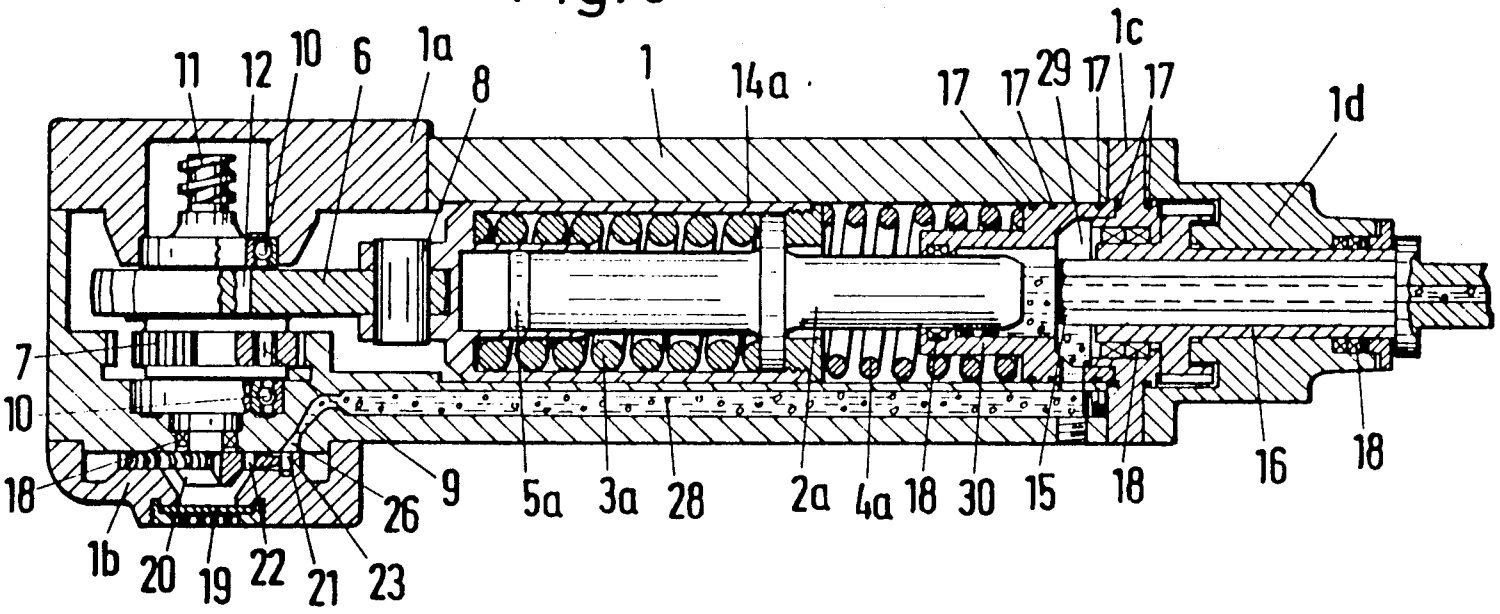

These and other objects and advantages of the invention will become more apparent from the detailed description taken in conjunction with the accompanying drawings wherein:

FIG. 1*a* illustrates a diagrammatic view of a movement-transmitting connection between a jumper rod and a turbine rotor of a hydraulic jackhammer in accordance with the invention;

FIG. 1*b* illustrates a diagrammatic view of a modified jackhammer constructed in accordance with the invention;

FIG. 2 illustrates a diagrammatic view of a turbine rotor, a means for directing a liquid stream against the rotor and a collecting nozzle in accordance with the invention; and FIG. 3 illustrates a cross-sectional view of a jackhammer constructed in accordance with the invention.

Referring to FIG. 1*a*, the hydraulic jackhammer includes a casing 1 and a tup 2*a* which is resiliently mounted within the casing 1 by means of resilient springs 3*a*, 4 for impacting against one end of a jumper rod 15. As indicated, the tup 2*a* is mounted in a guide head 14*a* which is movable in the striking direction by means of a transmission 7 which is connected via a connecting rod 6 to the guide head 14*a*, the transmission 7 drives an eccentric 12 which is connected to the connecting rod 6. The movement of the head 14*a* is shown plotted against time. A piston 5*a* is also provided as a damping means for the movement of the tup 2*a*.

As indicated in FIG. 1*a*, the tup 2*a* is guided within the guide head 14*a* via the spring 3*a* while the other spring 4 acts as a recoil spring.

Upon impact, the movement transmitted by the transmission 7 via the eccentric 12 and the connecting rod 6 to the guide head 14*a* is transmitted onwards by the spring 3*a* while the recoil spring 4*a* experiences further compression. The tup 2*a* is able to strike the jumper rod 15 in conventional fashion.

As indicated, the transmission 7 is connected via a drive shaft 13 to a chuck 16 in which the jumper rod 15 is mounted so that upon activation of the transmission 7, the drive shaft 13 rotates in the direction indicated by the arrow in order to rotate the chuck 16 and thus the jumper rod 15.

Activation of the transmission 7 is accomplished by means of a turbine rotor 20 which is rotatably mounted in the casing and which is operatively connected to the transmission 7. On rotation of the rotor 20, the transmission 7 is actuated. The rotor 20 is energized by means of a liquid stream 25 which is delivered via a feed nozzle 24. The liquid stream 25 impinging on the rotor 20 serves to rotate the rotor and thus drive the transmission 7.

Referring to FIG. 1*b*, wherein like reference characters indicate like parts as above, the jackhammer may be constructed so that a tup 2*b* is slidably mounted within a casing 1 in spaced relation to a guide head 14*b* which is also slidably mounted within the casing 1 and secured to a connecting rod 6. In this embodiment, the tup 2*b* serves to separate two chambers 3*b*, 4*b* within the casing 1 from each other. As indicated, the casing 1 is provided with bores 5*b* which act as equalizing bores and which alternately communicate with the chambers 3*b*, 4*b*, depending upon the position of the tup 2*b*.

As shown in FIG. 1*b*, the guide head 14*b* is used to drive the tup 2*b* against the jumper rod 15 through the use of air pressure. In this case, the pressure builds up within the chamber 3*b* in order to permit the guide head 14*b* to drive the tup 2*b* against the jumper rod 15. In addition, the air which becomes trapped within the chamber 4*b* serves as a recoil spring to damp the movement of the tup 2*b*.

Referring to FIG. 3, wherein like reference characters indicate like parts as above, the jackhammer casing is formed of five parts 1, 1*a*, 1*b*, 1*c*, 1*d*. The tup 2*a* is slidably mounted within a guide head 14*a* which is in the form of a hollow cylinder slidably mounted within the main casing 1 and is retained in place by a stop ring threaded into the end of the guide head and an enlarged collar thereon. In addition, a spring 3*a* is disposed between the collar on the tup 2*a* and the base of the guide head 14*a* while a recoilspring 4*a* is positioned between the stop ring and a flanged sleeve 30 fixedly mounted within the main casing 1. The closed end of the guide head 14*a* is connected by a pin 8 to a connecting rod 6 of the transmission 7.

As indicated, the transmission 7 is in the form of a planetary transmission having a satellite carrier mounted via a ball bearing 10 in the casing part 1*a*. The satellite carrier guides satellites having a pivot pin 9 and itself is in the form of an eccentric 12. In addition, balance weights are provided for balancing the weight of the eccentric 12. These balance weights provide an equalization of forces for the weights of the eccentric 12 and the connecting rod 6. These weights are accelerated transversely to the outwards or striking direction of the tup 2*a*.

As also indicated, the transmission has a worm 11 within the casing part 1*a* which meshes with the drive shaft 13 (see FIG. 1*a*). As indicated, the transmission 7 has a shaft which is rotatably mounted via bearings 18 within the casing 1.

The casing part 1*b* is secured on the main casing 1 by suitable means and is provided with an air opening across which an air filter 19 is provided in order to admit air into the casing 1.

The jackhammer includes a hollow jumper rod 15 which is mounted within a rotatable chuck 16 in the casing part 1*d*. In this respect, the chuck 16 is rotatably mounted within the casing parts 1*c*, 1*d* via suitable bearings 18. In addition, the casing part 1*c* is disposed between the main casing 1 and the casing part 1*d* and between the chuck 16 and the tup 2a so that a space is formed between the tup 2a and the end of the jumper rod 15. A suitable seal 17 is provided between the casing part 1c and the casing part 1d. Likewise, seals 17 are provided between the sleeve 30 and the main casing 1 and the casing part 1c.

As indicated, a piston 5a is formed on the left-end of the tup 2a, as viewed, for sliding in a chamber which serves as a work store.

As illustrated, the turbine rotor 20 is disposed in the casing part 1b on the shaft of the transmission 7 so as to rotate therewith. Referring to FIG. 2, the turbine rotor 20 includes a disk portion and a circumferential array of blades 21 about the disk portion with each blade 21 having a blade root mounted in the disk portion. In addition, a plurality of air flow apertures 22 are provided in the disk portion.

The casing part 1b includes a wall 23 which extends around the blades 21 with a reduced radial clearance, for example, a clearance of 0.3 millimeters. In addition, the rotor 20 has a reduced axial clearance, for example of 0.3 millimeters from the main casing 1 and the casing part 1b.

Referring to FIG. 2, the nozzle 24 serves as a means in the casing for directing at least one liquid stream 25 against the rotor 20 for rotating the rotor 20. In this respect, the liquid stream 25 impinges on the rotor blades 21 with a vector characterised by a tangential component of 80 to 96%, an axial component of 20 to 40% and a radial component of 0 to 15%, and issues from the blades 21 with a tangential component, an axial component and a radial component.

A collecting nozzle 26 is also disposed downstream of the rotor 20 for collecting and mixing the liquid after passage by the rotor 20 and air which passes through the filter 19 in the air opening. In this respect, the collecting nozzle 26 follows the contour of an exit side of the rotor 20 with a reduced clearance and has a reniform entry cross-section to receive the liquid passing from the rotor. In order to prevent flow back, the liquid stream is deformed by a substantial cross-section to a narrowed jet or the like within a narrow slide-like cross-section 27 of the nozzle. In this respect, the air-enriched liquid stream completely fills up the cross-section 27. A diffuser-like cross-section widens downstream of the narrow slide-like cross-section 27 to produce a pressure increase in the liquid-air mixture to several times atmospheric pressure.

The collecting nozzle 26 functions as an injector so that the liquid from the liquid stream 25 can be delivered downstream in the casing 1. To this end, the casing 1 is provided with a guide passage 28 which communicates with the nozzle 26 in order to receive the liquid-air mixture therefrom. In this respect, the proportion of air within the mixture is approximately 20% by volume. This guide passage 28 thus serves as a cooling passage for removing heat from the jackhammer.

As illustrated in FIG. 2, the entry cross-section of the nozzle 26 overlaps the blades 21 near the relieved blade roots and draws in through the resulting gap and through the apertures 22 and the rotor 20, air which enters the turbine casing lb through the air opening.

The collecting nozzle 26 also has an entry edge to receive liquid from the rotor 20 up to a maximum working speed of the rotor 20 and to inhibit overspeeding of the rotor 20 by impingement of the liquid on the entry edge.

Referring to FIG. 3, the guide passage 28 extends to a removable threaded plug in the main casing 1 and communicates with the exterior environment via a transverse orifice in the main casing 1 which is closed by a threaded plug. The guide passage 28 also communicates via a radial bore in the sleeve 30 with the end of the jumper rod 15.

The positive pressure of the liquid-air mixture in the guide passage 28 is approximately 1.5 bar. Any surplus mixture available for cooling is removed through the orifice in a lower part of the casing 1, as viewed in FIG. 3, so that, in a chamber 29 in a top part of the sleeve 30, an air cushion can form between the tup 2a and the jumper rod 15 when the casing 1 is horizontally disposed during operation. As indicated, the casing part 1c defines a wall between the chuck 16 and the tup 2a in order to seal the space therebetween. During operation, the chamber 29 briefly receives liquid in addition to the normally present air bubbles and is effective as a work store without any unnecessary increase in pressure during the displacement of the tup 2a. The sleeve 30 and the casing part 1c thus cooperate to form a pressure vessel which is open by way of the hollow jumper rod 15.

The seals 17 are static soft seals in order to provide seal tightness.

During operation, before the end faces of the tup 2a and the jumper rod 15 contact one another, the liquid therebetween forms a resistance to the force transmission. Further, this resistance increases during the duration of a transmitted pulse and ensures increased power transmission without the end faces being mechanically damaged.

A liquid feed line 24' as indicated in FIG. 2 may be connected to the feed nozzle 24 for delivering liquid thereto. In this case, idle striking of the jumper rod 15 can be prevented by interlocking the opening of the feed line to the nozzle 24 by way of the presence or setting up of an advancing force. The feature reduces water consumption and reduces wear of mechanical elements. A drilling operation can thus be started and stopped by starting and stopping the feeding of the liquid to the jackhammer.

The invention thus provides a jackhammer in which the power supply for operating the jackhammer is provided by a liquid stream, such as water, which is deflected by way of a turbine rotor connected to a transmission for driving the tup. The liquid stream then acts on the injector principle in a collecting nozzle to entrain air with its residual kinetic energy and is then retarded to increase its pressure after passing through a very narrow cross-section. Some of the resulting liquid-air mixture is then supplied as a washing and cooling liquid through the hollow jumper rod to a jumper bit for spraying onto surrounding rock in order to cool the rock. The chuck in which the jumper rod is mounted is rotated by way of a separate power take-up drive from the transmission.

What is claimed is:

1. A hydraulic jackhammer comprising a casing;

a jumper rod slidably mounted in said casing;

a resiliently mounted tup in said casing for impacting against one end of said jumper rod;

a transmission in said casing operatively coupled to said tup for driving said tup in a striking direction towards said jumper rod;

a turbine rotor in said casing operatively connected to said transmission for actuating said transmission in response to rotation of said rotor;

means in said casing for directing at least one liquid stream against said rotor for rotating said rotor;

an air opening in said casing adjacent said rotor for admitting air into said casing; and a collecting nozzle downstream of said rotor for collecting and mixing the liquid from said stream after passage by said rotor and air from said air opening.

2. A jackhammer as set forth in claim 1 wherein said rotor has a circumferential array of blades and said means directs the liquid stream onto said blades with a 20 to 40% axial component, an 80 to 96% tangential component and an at most 15% radial component.

3. A jackhammer as set forth in claim 1 wherein said rotor has a disc portion with a plurality of air flow apertures therein.

4. A jackhammer as set forth in claim 1 wherein said rotor has a disc portion and a circumferential array of blades about said disc-portion, each blade having a blade root mounted in said disc portion, said casing being disposed with an axially reduced clearance near said blades and said blade roots.

5. A jackhammer as set forth in claim 4 wherein said casing extends around said blades with a reduced radial clearance.

6. A jackhammer as set forth in claim 1 wherein said collecting nozzle follows the contour of an exit side of said rotor with clearance and has a reniform entry cross-section to receive the liquid passing from said rotor.

7. A jackhammer as set forth in claim 1 wherein said collecting nozzle includes a narrow slot-like cross-section for forming the collected liquid into a jet.

8. A jackhammer as set forth in claim 7 wherein said nozzle has a diffuser-like cross-section widening downstream of said narrow slot-like cross-section.

9. A jackhammer as set forth in claim 1 wherein said collecting nozzle has an entry edge to receive liquid from said rotor up to a maximum working speed thereof and to inhibit overspeeding of said rotor by impingement of liquid on said entry edge.

10. A jackhammer as set forth in claim 1 wherein said transmission is a planetary transmission having an eccentric thereon a connecting rod connecting said eccentric to said tup.

11. A jackhammer as set forth in claim 1 which further comprises a chuck receiving said jumper rod, and a peripheral casing wall enclosing and sealing a space between said wall, said tup and said chuck.

12. A jackhammer as set forth in claim 11 wherein said space defines a chamber above said jumper rod with said casing horizontally disposed in operation for receiving an air cushion.

13. A jackhammer as set forth in claim 1 which further comprises a guide passage communicating with said collecting nozzle and extending within said casing to said jumper rod for conducting the liquid and air mixture therethrough t cool said casing.

14. A jackhammer as set forth in claim 1 wherein said means includes a feed nozzle for directing a liquid stream against said rotor.

15. A jackhammer as set forth in claim 14 which further comprises a liquid feed line connected to said feed nozzle for delivering liquid thereto.

16. A hydraulic jackhammer comprising a casing;

a jumper rod slidably mounted at one end of said casing;

a tup mounted in said casing for impacting against one end of said jumper rod;

a transmission in said casing operatively coupled to said tup for driving said tup in a striking direction towards said jumper rod;

a turbine rotor in said casing operatively connected to said transmission for actuating said transmission in response to rotation of said rotor; and means in said casing for directing at least one liquid stream against said rotor for rotating said rotor.

17. A jackhammer as set forth in claim 16 which further comprises an air opening in said casing adjacent said rotor for admitting air into said casing; and a collecting nozzle downstream of said rotor for collecting and mixing the liquid from said stream after passage by said rotor and air from said air opening.

18. A jackhammer as set forth in claim 17 which further comprises a guide passage communicating with said collecting nozzle and extending within said casing to said jumper rod for conducting the liquid and air mixture therethrough to cool said casing.

19. A jackhammer as set forth in claim 18 wherein said jumper rod is hollow and communicates with said guide passage to receive the liquid and air mixture therefrom for cooling of said rod.

20. A jackhammer as set forth in claim 16 wherein said transmission includes a guide head slidably mounted in said casing in spaced relation to said tup to drive said tup under air pressure.

21. A method of operating a jackhammer comprising the steps of passing a liquid stream against a turbine rotor within a casing of the jackhammer to at least partially energize said rotor to effect a rotation and striking movement of a hollow jumper rod;

drawing ambient air into said casing;

collecting the liquid passing from the rotor and air drawn into the casing to form a liquid-air mixture;

increasing the pressure on the liquid-air mixture several times atmospheric pressure;

discharging surplus liquid-air mixture to the environment;

forming a resilient air cushion in a chamber between the jumper rod and the tup prior to movement of the tup against the jumper rod while permitting the chamber to receive liquid displaced upon impacting of the tup on the jumper rod; and supplying the liquid-air mixture to the hollow jumper rod as a cooling and washing agent.

22. A hydraulic jackhammer comprising a casing having at least a pair of bores;

a jumper rod slidably mounted in said casing;

a tup slidably mounted in said casing for impacting against one end of said jumper rod and for separating two chambers within said casing from each other, said tup being sized to permit said bores to alternately communicate with said chambers;

a transmission including a guide head slidably mounted in said casing for driving said tup in a striking direction towards said jumper rod;

a turbine rotor in said casing operatively connected to said transmission for actuating said transmission in response to rotation of said rotor; and means in said casing for directing at last one liquid stream against said rotor for rotating said rotor.

23. A jackhammer as set forth in claim 22 which further comprises an air opening in said casing adjacent said rotor for admitting air into said cashing; and a collecting nozzle downstream of said rotor for collecting and mixing the liquid from said stream after passage by said rotor and air from said air opening.

* * * * *